US012595621B2

(12) United States Patent
Chei

(10) Patent No.: US 12,595,621 B2
(45) Date of Patent: Apr. 7, 2026

(54) METHOD FOR MANUFACTURING PRINTING SHEET FOR DIGITAL PRINTING USING SCREEN YARN WOVEN WITH POLYESTER MONOFILAMENT AND PRINTING SHEET FOR DIGITAL PRINTING MANUFACTURED BY THE SAME

(71) Applicant: TAEKEYSANJA Co, Ltd, Hanam-si (KR)

(72) Inventor: Young Han Chei, Namyangju-si (KR)

(73) Assignee: TAEKEYSANJA Co, Ltd, Hanam-si (KR)

( * ) Notice: Subject to any disclaimer, the term of this patent is extended or adjusted under 35 U.S.C. 154(b) by 49 days.

(21) Appl. No.: 18/585,065

(22) Filed: Feb. 23, 2024

(65) Prior Publication Data

US 2024/0309581 A1 Sep. 19, 2024

(30) Foreign Application Priority Data

Mar. 16, 2023 (KR) ..... 10-2023-0034419

(51) Int. Cl.
*D06N 3/04* (2006.01)
*D01F 1/10* (2006.01)
(Continued)

(52) U.S. Cl.
CPC ..... *D06N 3/04* (2013.01); *D01F 1/10* (2013.01); *D01F 8/14* (2013.01); *D03D 1/00* (2013.01);
(Continued)

(58) Field of Classification Search
CPC ..... D06N 3/04; D06N 3/0006; D06N 3/0036; D06N 3/0063; D06N 3/0077
See application file for complete search history.

(56) References Cited

U.S. PATENT DOCUMENTS

2010/0151244 A1* 6/2010 Oka ..... B41N 1/247 528/271
2011/0287676 A1* 11/2011 Ichikawa ..... D01D 7/00 442/1

FOREIGN PATENT DOCUMENTS

KR 100743156 B1 7/2007
KR 20110038444 A 4/2011
(Continued)

OTHER PUBLICATIONS

Merriam Webster. Primary. https://www.merriam-webster.com/dictionary/primarily (Year: 2025).*
(Continued)

*Primary Examiner* — Dah-Wei D. Yuan
*Assistant Examiner* — Kristen A Dagenais
(74) *Attorney, Agent, or Firm* — NKL Law; Jae Youn Kim

(57) ABSTRACT

Provided is a method for manufacturing a printing sheet for digital printing using a screen yarn woven with a polyester monofilament capable of directly outputting (printing) by a digital printing machine (a digital inkjet plotter, a printer, etc.) and a printing sheet for digital printing according to the same, and more particularly, to a method for manufacturing a printing sheet for digital printing using a screen yarn woven with a polyester monofilament by a post-processing including first and second coating processes, a compression process, a drying process, a side cutting process, and a winding process and a printing sheet for digital printing manufactured by the same.

11 Claims, 11 Drawing Sheets

(51) Int. Cl.

| | |
|---|---|
| ***D01F 8/14*** | (2006.01) |
| ***D03D 1/00*** | (2006.01) |
| ***D03D 15/283*** | (2021.01) |
| ***D03D 15/292*** | (2021.01) |
| ***D06C 7/00*** | (2006.01) |
| ***D06C 13/00*** | (2006.01) |
| ***D06N 3/00*** | (2006.01) |

(52) U.S. Cl.
CPC ..... *D03D 15/283* (2021.01); *D03D 15/292* (2021.01); *D06C 7/00* (2013.01); *D06C 13/00* (2013.01); *D06N 3/0006* (2013.01); *D06N 3/0036* (2013.01); *D06N 3/0063* (2013.01); *D06N 3/0077* (2013.01); *D06N 3/0088* (2013.01); *D06N 2201/10* (2013.01); *D10B 2331/04* (2013.01); *D10B 2401/063* (2013.01); *D10B 2505/00* (2013.01)

(56) References Cited

FOREIGN PATENT DOCUMENTS

| | | |
|---|---|---|
| KR | 102247423 B1 | 5/2021 |
| KR | 102384657 B1 | 4/2022 |

OTHER PUBLICATIONS

Merriam Webster. Secondarily. https://www.merriam-webster.com/dictionary/secondary (Year: 2025).*

* cited by examiner

METHOD FOR MANUFACTURING PRINTING SHEET FOR DIGITAL PRINTING USING SCREEN YARN WOVEN WITH POLYESTER MONOFILAMENT AND PRINTING SHEET FOR DIGITAL PRINTING MANUFACTURED BY THE SAME

CROSS-REFERENCE TO RELATED APPLICATIONS

This U.S. non-provisional patent application claims priority under 35 U.S.C. § 119 of Korean Patent Application No. 10-2023-0034419, filed on Mar. 16, 2023, the entire contents of which are hereby incorporated by reference.

BACKGROUND

The present invention relates to a method for manufacturing a printing sheet for digital printing using a screen yarn woven with a polyester monofilament capable of directly outputting (printing) by a digital printing machine (a digital inkjet plotter, a printer, etc.) and a printing sheet for digital printing manufactured by the same.

More particularly, the present invention relates to a method for manufacturing a printing sheet for digital printing using a screen yarn woven with a polyester monofilament by a post-processing including first and second coating processes, a compression process, a drying process, a side cutting process, and a winding process and a printing sheet for digital printing manufactured by the same.

A work of illustrating a specific design (a photograph, a design, and a graphic image) on a banner or a sign used for commercial advertisement and on a woven fabric used for interior decoration uses methods such as printing, dyeing, and transfer. The design illustrating work using respective methods increases production costs because the work is extremely complex and requires a long working time.

In recent years, as computers and color printing machines are increasing provided, a woven fabric sheet for actual image printing by plotters or color printers is used for advertising banners installed indoors and outdoors or for other image output purposes and is conveniently used as a result of research and development on a woven fabric used for design output by color printing machines.

However, since the woven fabric suitable for the color printing machines is manufactured by applying a scouring and desizing process to a fabric, the woven fabric inevitably has a high price due to a complex manufacturing process and causes many losses due to shrinkage of the fabric and damages of pretreatment processes during the scouring and desizing process. Also, ink printed on the woven fabric is seriously smeared due to characteristics of ink used for the color printing machines, color development of a design illustrated on the woven fabric is degraded, and the printed design is easily discolored.

The woven fabric sheet for actual image printing, which is recently produced and sold, is manufactured by a process of forming an agent by mixing various types of agents and additives with a predetermined ratio, then coating the polyester fabric with the agent, and then performing a drying process or a post-processing process on the polyester fabric coated with the agent under a predetermined condition.

However, the woven fabric according to the related art requires an additional release coating film process after banner printing in case of using oil and requires a process of attaching a rubber pad before processing a banner film and then processing and installing an I-net when processing the steel I-Net in case of being used an indoor or outdoor banner. Thus, the woven fabric according to the related art requires a long working time and causes damages.

Also, a PET film banner that is the woven fabric according to the related art may not be produced with a large-size due to a size limitation and may be bent during printing and frequently generate a sharp surface during cutting after printing, requiring careful attention during work.

RELATED ART DOCUMENTS

Patent Documents (Patent document 1) Korean Patent Registration No. 10-0743156 (Jul. 30, 2007)

(Patent document 2) Korean Patent Publication No. 10-2011-0038444 (Apr. 14, 2011)

(Patent document 3) Korean Patent Registration No. 10-2247423 (May 4, 2021)

(Patent document 4) Korean Patent Registration No. 10-2384657 (Apr. 11, 2022)

SUMMARY

The present invention provides a method for manufacturing a printing sheet for digital printing using a screen yarn woven with a polyester monofilament and a printing sheet for digital printing manufactured by the same, which is combined with various technologies such as oil (solvent) printing, PVC cal printing, water-based printing, UV printing, latex printing, and fluorescent printing to realize excellent printing output in comparison with a conventional woven fabric and is excellent in terms of durability, heat resistance, and weatherability, in order to solve the above-described limitations generated when conventional fabric sheets for actual image printing are processed.

The present invention also provides a method for manufacturing a printing sheet for digital printing using a screen yarn woven with a polyester monofilament and a printing sheet for digital printing manufactured by the same, which does not cause scratches or damages on a printed surface even without using a release coating film, is suitable for a printing material in terms of paper texture and shading, and is useful for inventory and inventory risk management because the printing sheet has superior competitiveness and a multiple printing capability in comparison with conventional technologies.

The present invention also provides a method for manufacturing a printing sheet for digital printing using a screen yarn woven with a polyester monofilament and a printing sheet for digital printing manufactured by the same, which is advantageous in terms of improved process rate and productivity through a punching process immediately after printing, a reduced delivery delay time, and a reasonable price.

The present invention also provides a method for manufacturing a printing sheet for digital printing using a screen yarn woven with a polyester monofilament and a printing sheet for digital printing manufactured by the same, which may: realize a natural state such as scenery thereon through sewing after printing; perform sales and advertisements such as large concert halls, department stores, and large discount marts because the printing sheet may realize a large-sized printed material regardless of sizes; and be displayed for a long period of time due to excellent durability and weatherability in comparison with a banner.

The present invention also provides a method for manufacturing a printing sheet for digital printing using a screen yarn woven with a polyester monofilament and a printing sheet for digital printing manufactured by the same, which may be recycled from various environmental factors that may occur during disposal after displaying a printed material based on an eco-friendly coating agent and water-based composition and secure excellent printability without being affected by humidity and temperature based on excellent weatherability.

An embodiment of the inventive concept provides a method for manufacturing a printing sheet for digital printing by using a screen yarn woven with a polyester monofilament, the method including: a process S100 of preparing a screen yarn fabric woven appropriately for high-precision printing by using the polyester monofilament for at least 50 wt % of warp and/or weft yarns in a method of mechanically maintaining or feeding the weft yarn; a first knife coating process S200 of performing surface treatment while cutting a surface of the screen yarn fabric woven with polyester monofilaments by a first comma coating machine in a gap between a first comma knife of the first comma coating machine and the screen yarn fabric coated with a coating solution; a second knife coating process S300 of secondarily knife-coating the screen yarn, which is primarily knife-coated in the first knife coating process by the first comma coating machine, by a second comma coating machine as same as the first knife coating process to secure an excellent coating property without liquidity; a transfer process S400 of transferring the screen yarn that has undergone the first and second knife coating processes S200 and S300 to a heating chamber by a transfer device in order to dry the screen yarn; a first drying process S500 of thermally drying the screen yarn that has undergone the first and second knife coating processes S200 and S300 through a heating chamber having a temperature of 180° C. to 220° C.; a side cutting process S600 of cutting both side gripping surfaces of the secondarily knife-coated screen yarn that is thermally dried while passing the heating chamber in the process S500 by a side cutter to side-cut both side surfaces into various widths of a constant size; a winding process S700 of forming the secondarily knife-coated screen yarn that has a predetermined width by side-cutting the both left and right gripping surfaces in the process S600 into various sizes by using a winder.

In an embodiment, the method may further include a second drying process S800 of performing a thermal curing process on the screen yarn that has undergone the winding process S700 at a room temperature of 40° C. by a blower.

In an embodiment, the coating solution, which is a milky white viscous liquid of a PVA resin component, may have a solid content of 20.0±1.0% and a viscosity of 700±100 CPS.

In an embodiment, the coating solution may consist of 5 to 15% of isopropyl alcohol, 10 to 20% of ethylene-vinylacetate-vinyl alcohol trimer, 5 to 15% of silica, 45 to 60% of water, 2 to 10% of polyvinyl alcohol polymers.

In an embodiment, the first knife coating process may include: pushing the prepared screen yarn fabric upward along a rotating first coating roll of a first comma coating machine and impregnating and coating the screen yarn fabric with the coating solution, which is a milky white viscous liquid filled in a coating solution tank; performing surface treatment uniformly on the coated screen yarn by a first comma knife of the first comma coating machine; and performing a compression process on the screen yarn fabric to have a predetermined thickness by a first vertical compression roller of the first comma coating machine, so as to knife-coat the screen yarn woven with polyester monofilament by the first comma coating machine.

In an embodiment, the first knife coating process may include: a first coating process S210 of impregnating the screen yarn fabric prepared in the process S100 while passing through the coating solution tank along the first coating roll of the first comma coating machine rotating to transfer the screen yarn fabric and coating the screen yarn with the coating solution that is a milky white viscous liquid of a PVA resin component; a first knife cutting process S220 of performing surface treatment while cutting a surface of the screen yarn, which is coated by a first comma knife of the first comma coating machine, to uniformly perform the surface treatment on the surface of the screen yarn that is primarily coated in the process S210; and a first compression process S230 of compressing the primarily knife-coated screen yarn with a predetermined thickness while the screen yarn that has undergone the surface treatment constantly by the first knife cutting process S220 passes the first vertical compression roller of the first comma coating machine.

In an embodiment, the second knife coating process may include: pushing the knife-coated screen yarn that has undergone the first knife coating process upward along a rotating second coating roll of the second comma coating machine and impregnating and coating the screen yarn with the coating solution that is a milky white viscous liquid of a PVA resin component filled in the coating solution tank as a second coating solution; performing surface treatment uniformly on a surface of the screen yarn coated by a second comma knife of the second comma coating machine; and knife-coating the screen yarn to have a predetermined thickness through a compression process by a second vertical compression roller of the second comma coating machine.

In an embodiment, the second knife coating process may include: a second coating process S310 of impregnating the screen yarn while passing through the coating solution tank along the second coating roll of the second comma coating machine rotating to transfer the screen yarn that has undergone the first knife coating process S200 and secondarily coating the screen yarn with the coating solution that is the milky white viscous liquid of the PVA resin component; a second knife cutting process S320 of performing surface treatment while cutting a surface of the screen yarn, which is secondarily coated by the second comma knife of the second comma coating machine, to uniformly perform the surface treatment on the surface of the screen yarn that has undergone the second coating process S310; and a second compression process S330 of compressing the secondarily knife-coated screen yarn with a predetermined thickness while the screen yarn that has undergone the surface treatment constantly by the second knife cutting process S320 passes the second vertical compression roller to secure stability of the fabric.

In an embodiment, the polyester monofilament may be a core-sheath type composite polyester monofilament in which both a core component and a sheath component are polyethylene terephthalate (PET) and the sheath component has an intrinsic viscosity less by at least 0.2 than that of the core component.

In an embodiment, the polyester monofilament may be characterized in that both a core component and a sheath component are polyethylene terephthalate (PET) has a fineness of 3 to 8 dtex, a strength of 7.5 cN/dtex or more, a toughness (strength×elongation 0.5) of 29 or more, a yarn length fineness variation of 1.5% or less. In the polyester monofilament, a diameter portion having a thickness of +20% or more with respect to an average fiber diameter of a cross-section of the monofilament is 1/100,000 m or less, PET of the core component contains less than 0.5 wt % of titanium oxide, and PET of the sheath component contains 0.3 wt % or more and 0.5 wt % or less of titanium oxide.

In an embodiment, PET of one of the core component and sheath component of the polyester monofilament may contain a copolymerization component, and an additive such as monofilament, antioxidants, antistatic agents, plasticizers, ultraviolet absorbers, and colorants may be added to the PET of one of the core and sheath components of the polyester monofilament.

In an embodiment, the copolymerization component may contain: an acid component including a bifunctional aromatic carboxylic acid of one of isophthalic acid, phthalic acid, dibromoterephthalic acid, naphthalene dicarboxylic acid, diphenylxyentanecarboxylic acid, and oxyethoxybenzoic acid and a bifunctional aliphatic carboxylic acid of one of sebacic acid, adipic acid, and oxalic acid, and cyclohexane dicarboxylic acid; and a glycol component including polyoxyalkylene glycol of one of propanediol, butanediol, neopentyl glycol, bisphenol A, polyethylene glycol, or polyoxyalkylene glycol.

In an embodiment, PET of one of the core component and sheath component of the polyester monofilament may contain a copolymerization component, and an additive such as antioxidants, antistatic agents, plasticizers, ultraviolet absorbers, and colorants may be added to the PET of one of the core and sheath components of the polyester monofilament.

In an embodiment, the copolymerization component may include: an acid component including a bifunctional aromatic carboxylic acid of one of isophthalic acid, phthalic acid, dibromoterephthalic acid, naphthalene dicarboxylic acid, diphenylxyentanecarboxylic acid, and oxyethoxybenzoic acid and a bifunctional aliphatic carboxylic acid of one of sebacic acid, adipic acid, and oxalic acid, and cyclohexane dicarboxylic acid; and a glycol component including polyoxyalkylene glycol of one of propanediol, butanediol, neopentyl glycol, bisphenol A, polyethylene glycol, or polyoxyalkylene glycol.

In an embodiment of the inventive concept, a printing sheet for digital printing is formed by the method of claim 1.

In an embodiment of the inventive concept, a printing sheet for digital printing is formed by the method of claim 2.

In an embodiment of the inventive concept, a printing sheet for digital printing is formed by the method of claim 3.

In an embodiment of the inventive concept, a printing sheet for digital printing is formed by the method of claim 4.

In an embodiment of the inventive concept, a printing sheet for digital printing is formed by the method of claim 5.

In an embodiment of the inventive concept, a printing sheet for digital printing is formed by the method of claim 6.

In an embodiment of the inventive concept, a printing sheet for digital printing is formed by the method of claim 7.

In an embodiment of the inventive concept, a printing sheet for digital printing is formed by the method of claim 8.

In an embodiment of the inventive concept, a printing sheet for digital printing is formed by the method of claim 9.

In an embodiment of the inventive concept, a printing sheet for digital printing is formed by the method of claim 10.

In an embodiment of the inventive concept, a printing sheet for digital printing is formed by the method of claim 11.

BRIEF DESCRIPTION OF THE FIGURES

The accompanying drawings are included to provide a further understanding of the inventive concept, and are incorporated in and constitute a part of this specification. The drawings illustrate exemplary embodiments of the inventive concept and, together with the description, serve to explain principles of the inventive concept. In the drawings.

DETAILED DESCRIPTION

Figure 1:
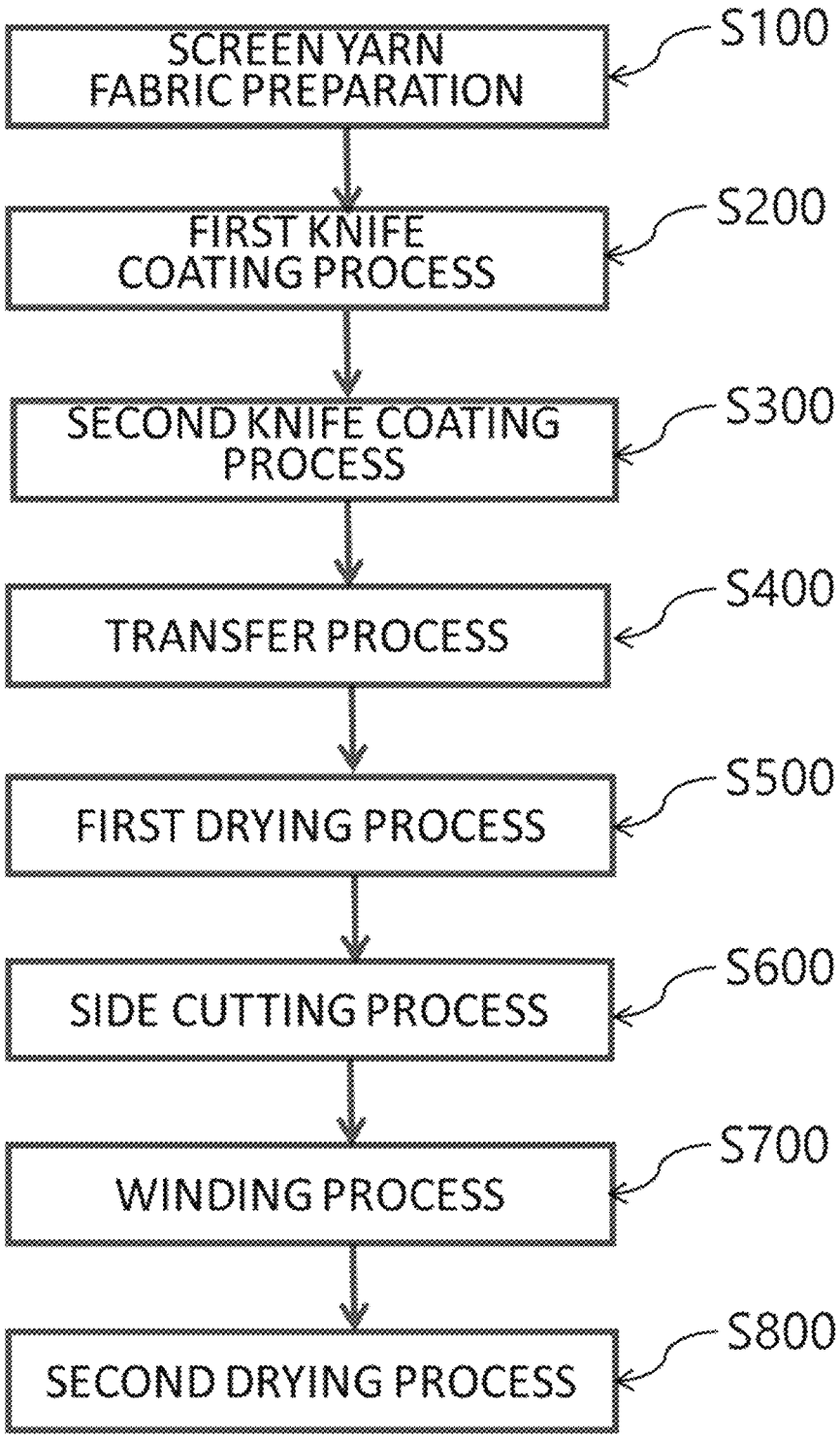
FIG. 1 is a flowchart representing a method for manufacturing a printing sheet for digital printing using a screen yarn woven with a polyester monofilament according to the present invention.
Figure 2:
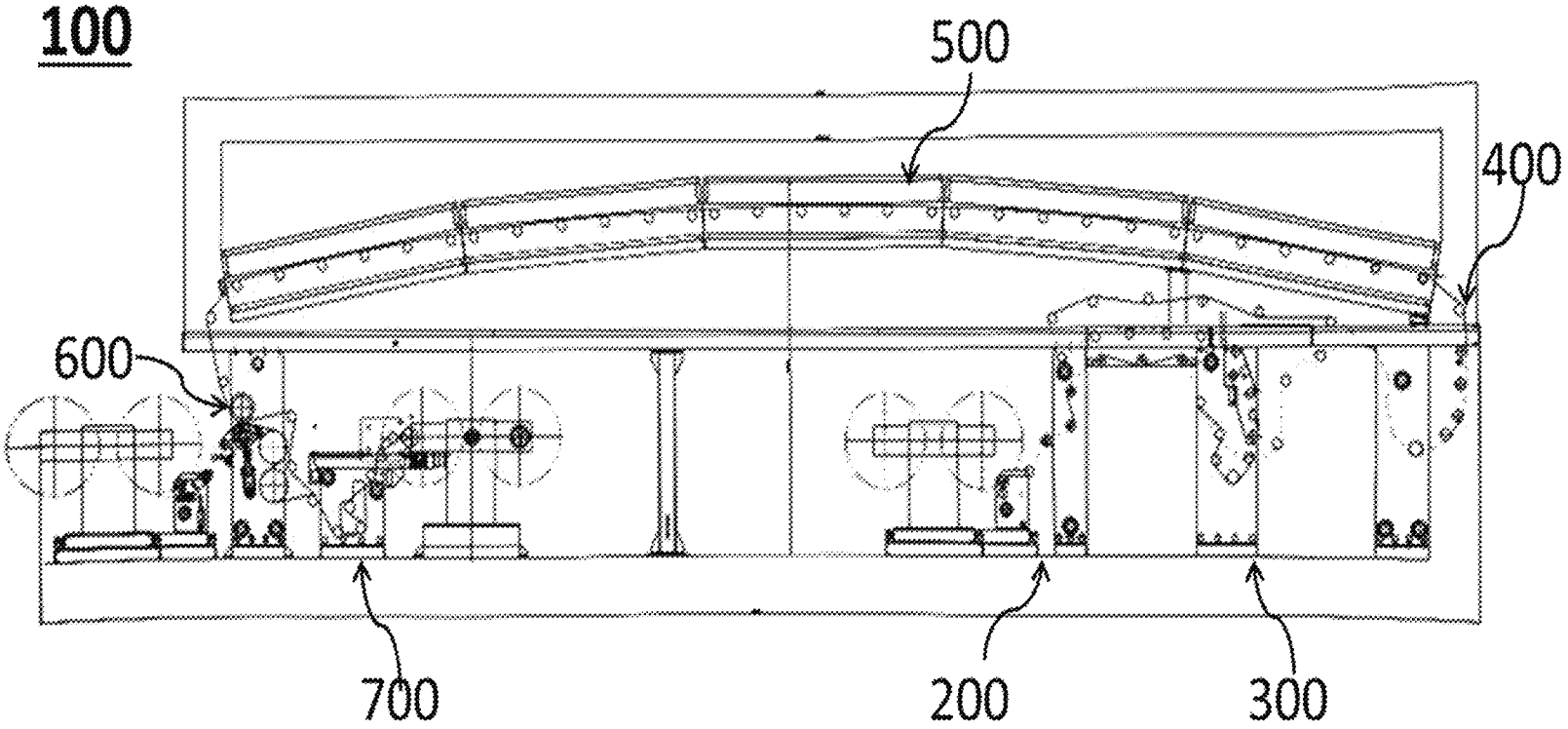
FIG. 2 is a full front view illustrating an entire apparatus for manufacturing the printing sheet for digital printing using the screen yarn woven with polyester monofilament according to the present invention.
Figure 3:
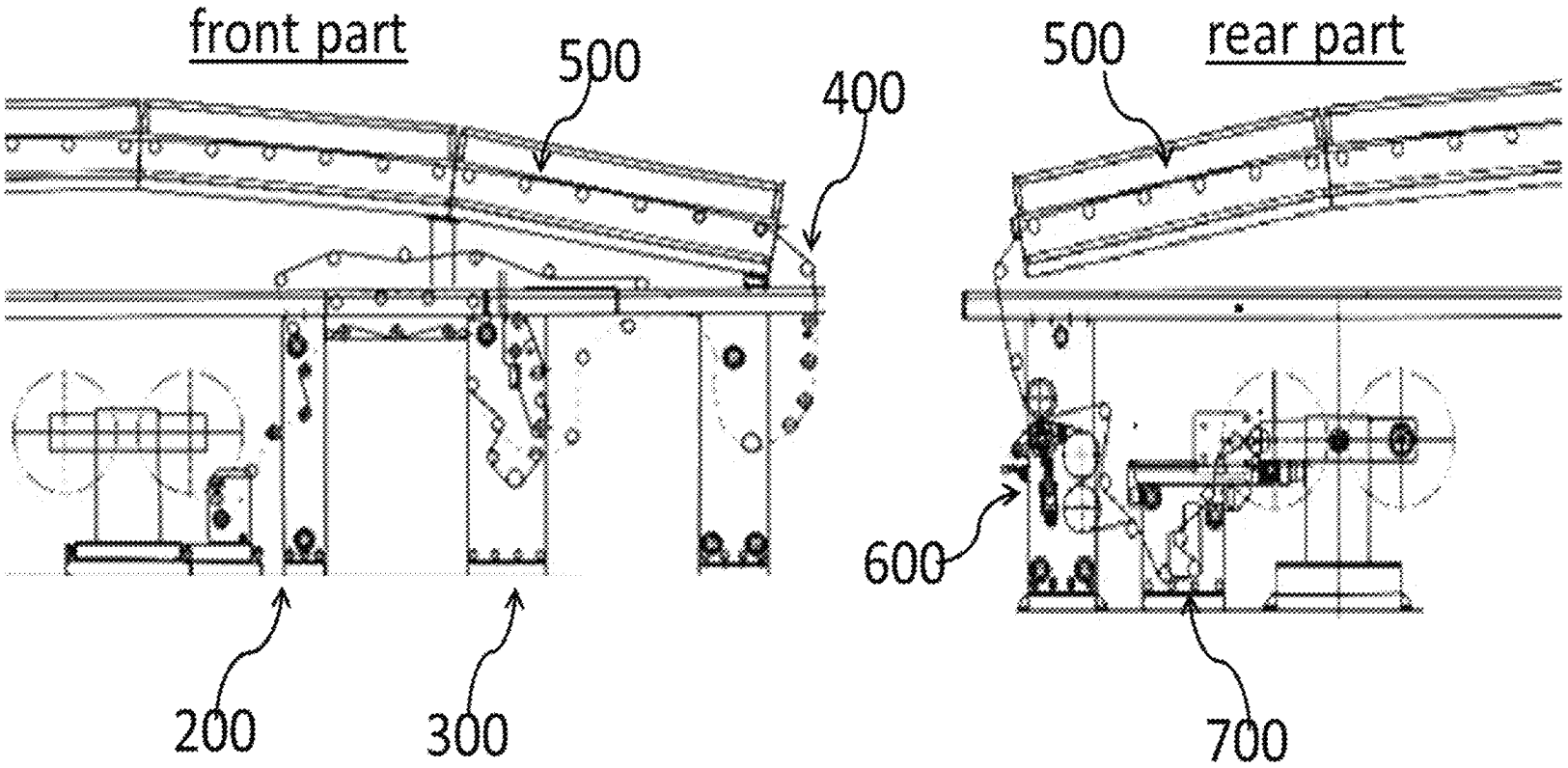
FIG. 3 is a partially enlarged view illustrating the entire apparatus for manufacturing the printing sheet for digital printing using the screen yarn woven with polyester monofilament according to the present invention.
Figure 4:
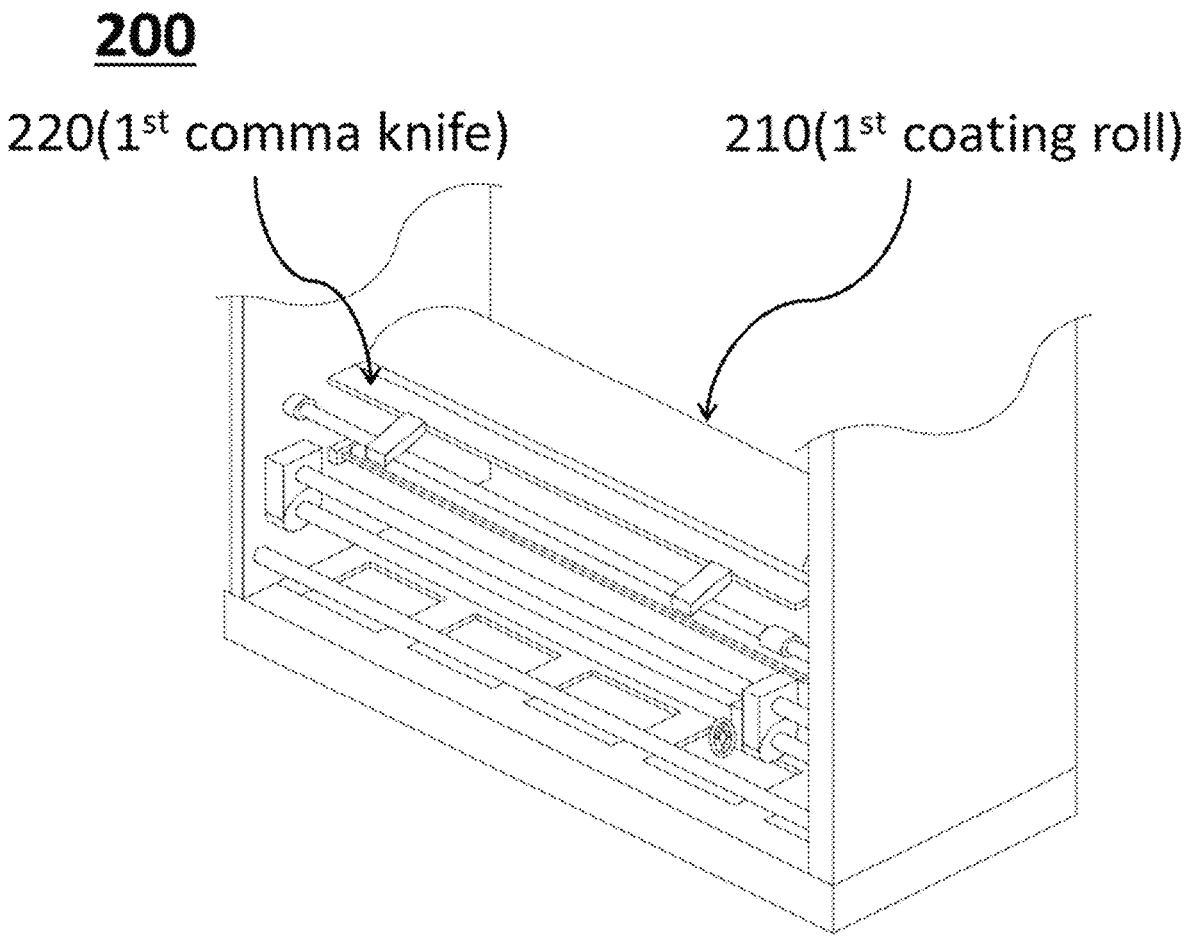
FIG. 4 is a view illustrating a first comma coating machine in a first knife coating process in the apparatus for manufacturing the printing sheet for digital printing according to the present invention.
Figure 5:
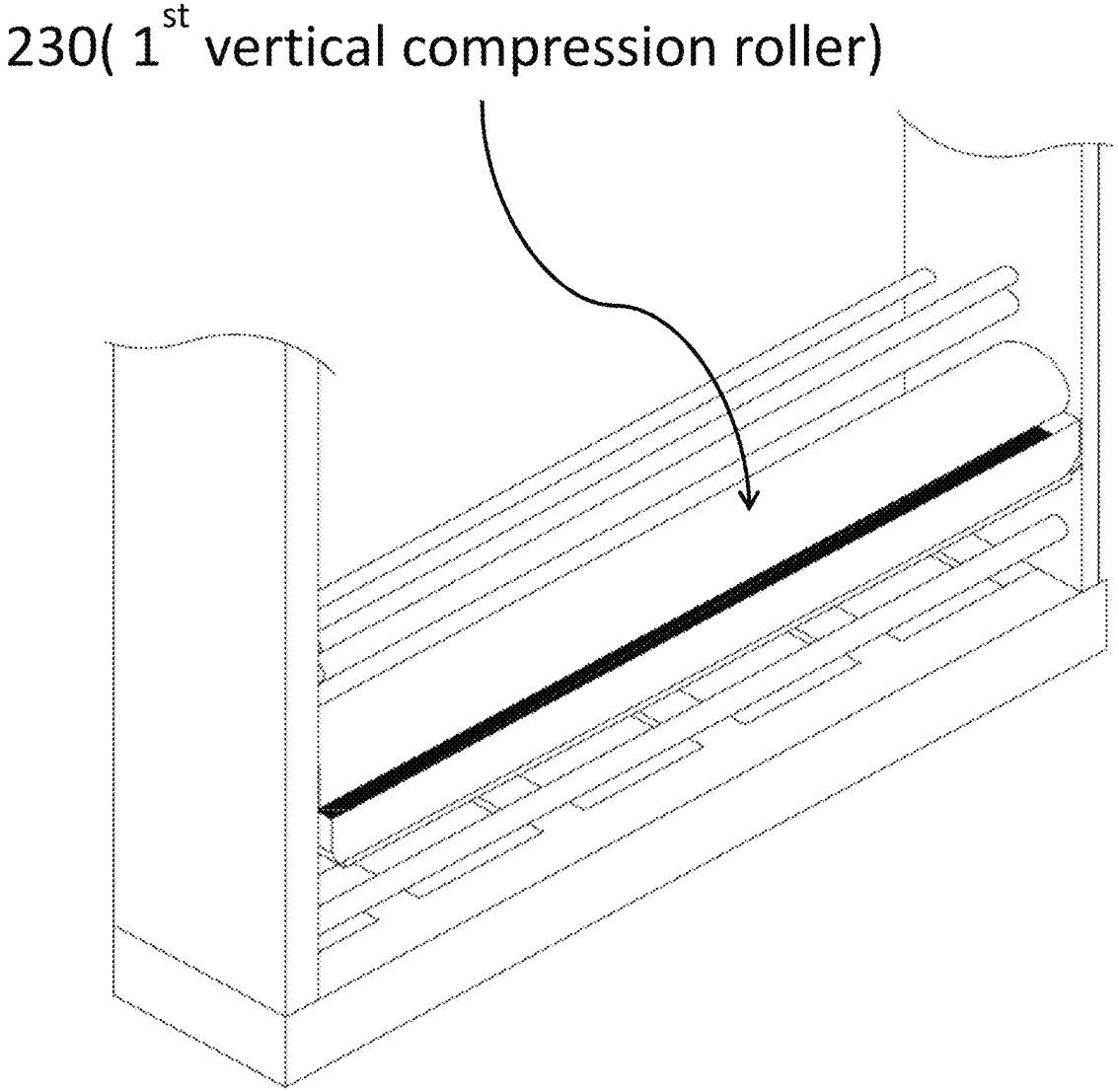
FIG. 5 is a view illustrating a first vertical compression roller for primary compression of a first comma coating machine in the apparatus for manufacturing the printing sheet for digital printing according to the present invention.
Figure 6:
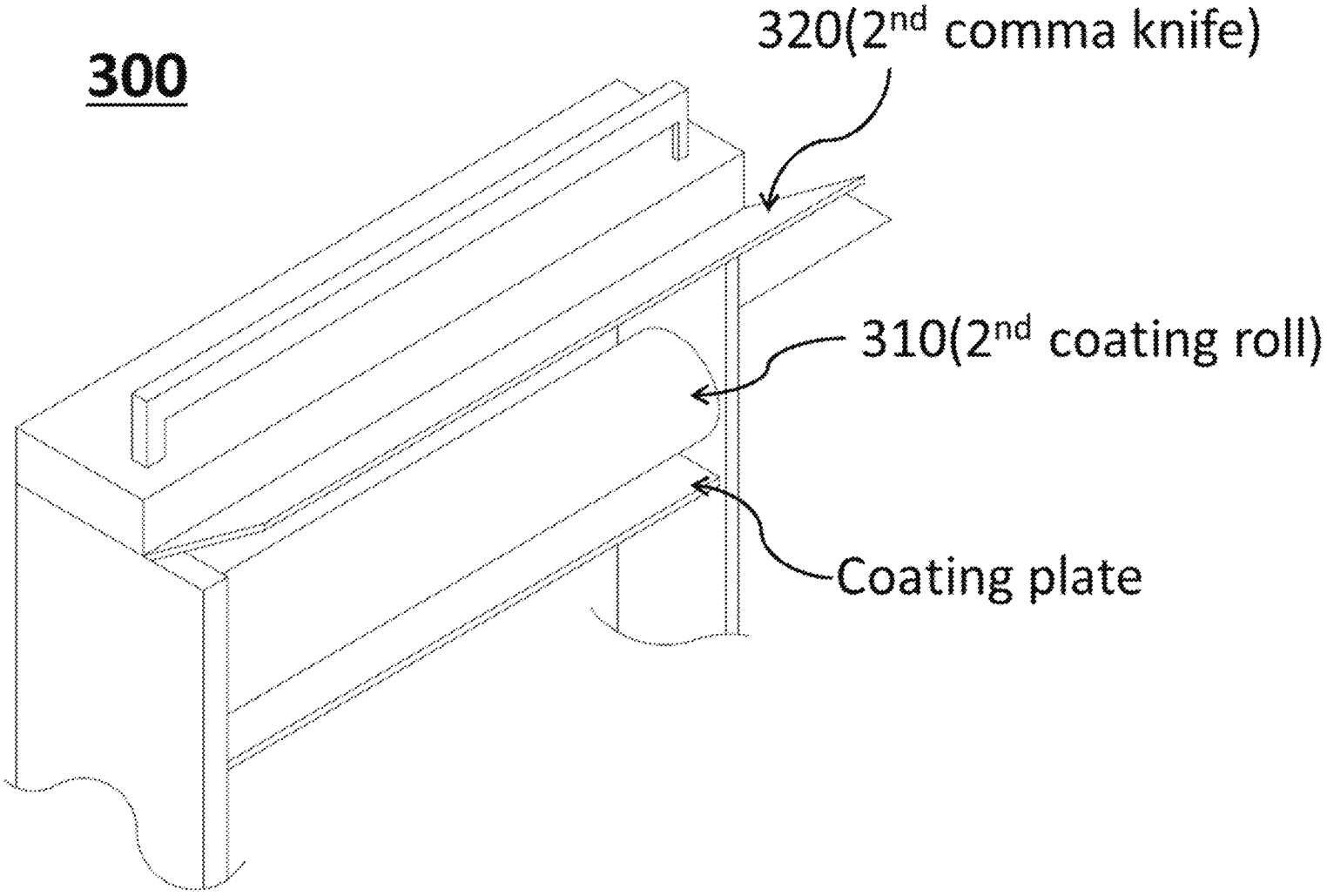
FIG. 6 is a view illustrating a second comma coating machine in a second knife coating process in the apparatus for manufacturing the printing sheet for digital printing according to the present invention.
Figure 7:
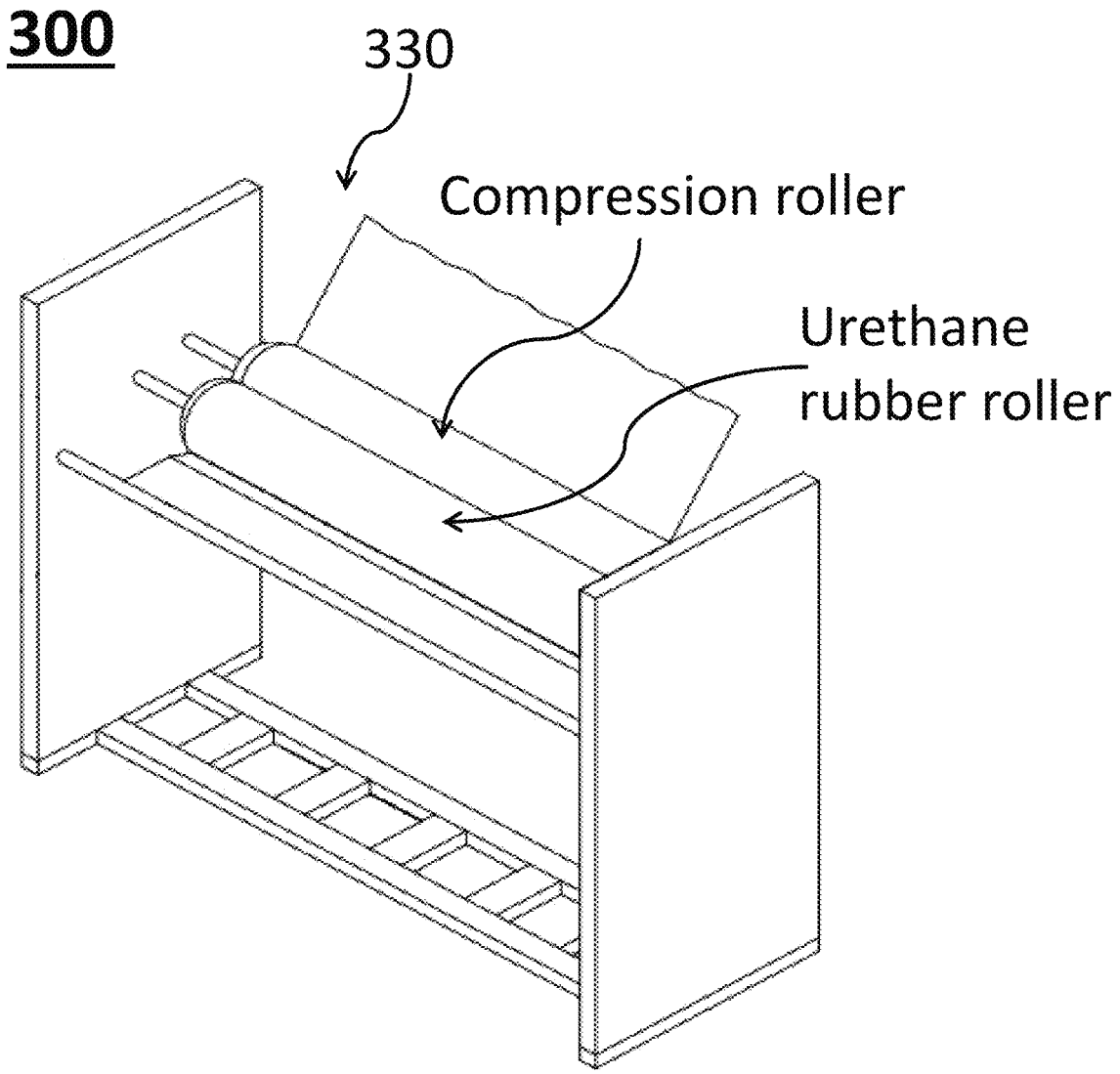
FIG. 7 is a view illustrating a second vertical compression roller for second compression of in the second knife coating process in the apparatus for manufacturing the printing sheet for digital printing according to the present invention.
Figure 8:
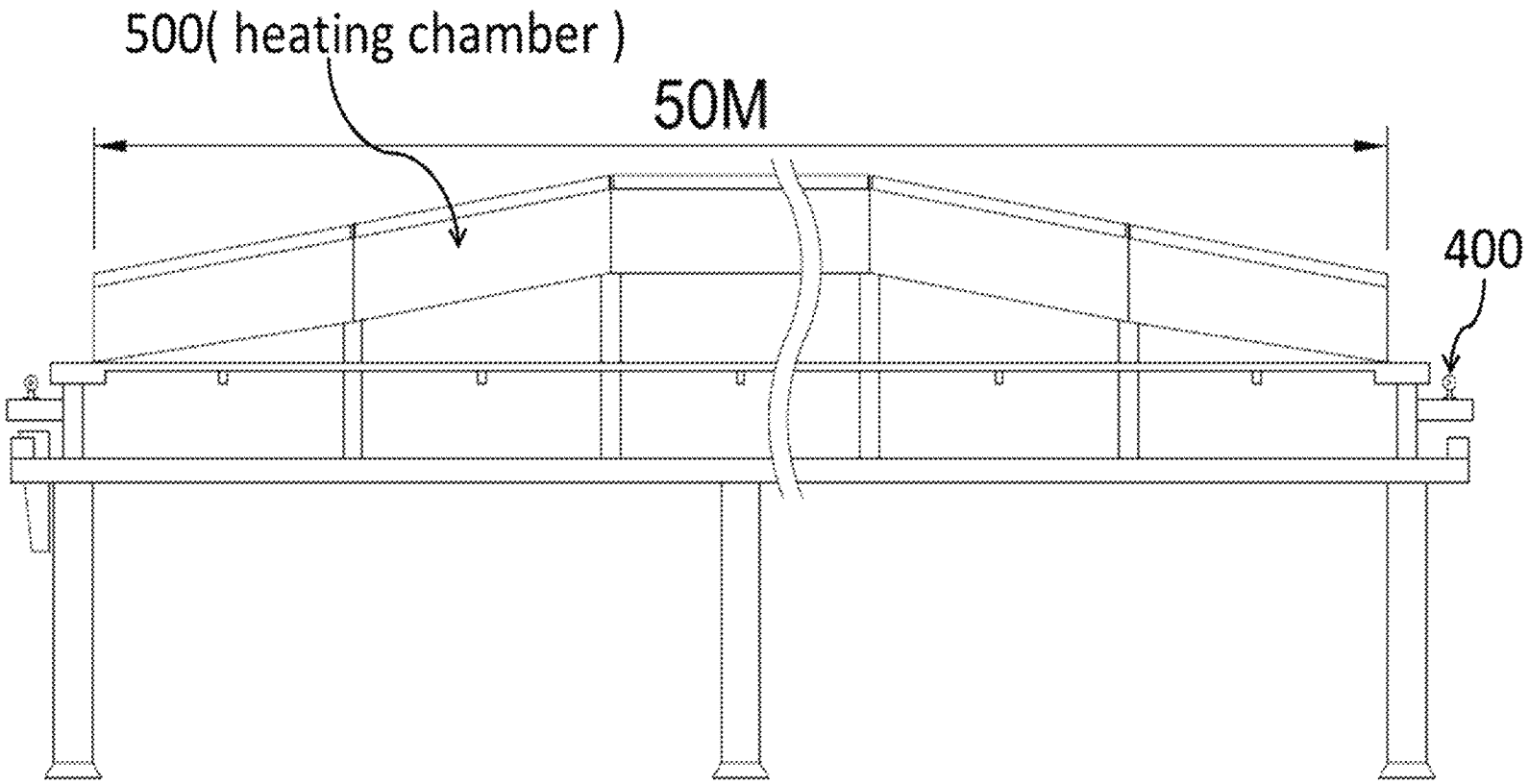
FIG. 8 is a full front view illustrating a heating chamber for performing a drying process in the apparatus for manufacturing the printing sheet for digital printing according to the present invention.
Figure 9:
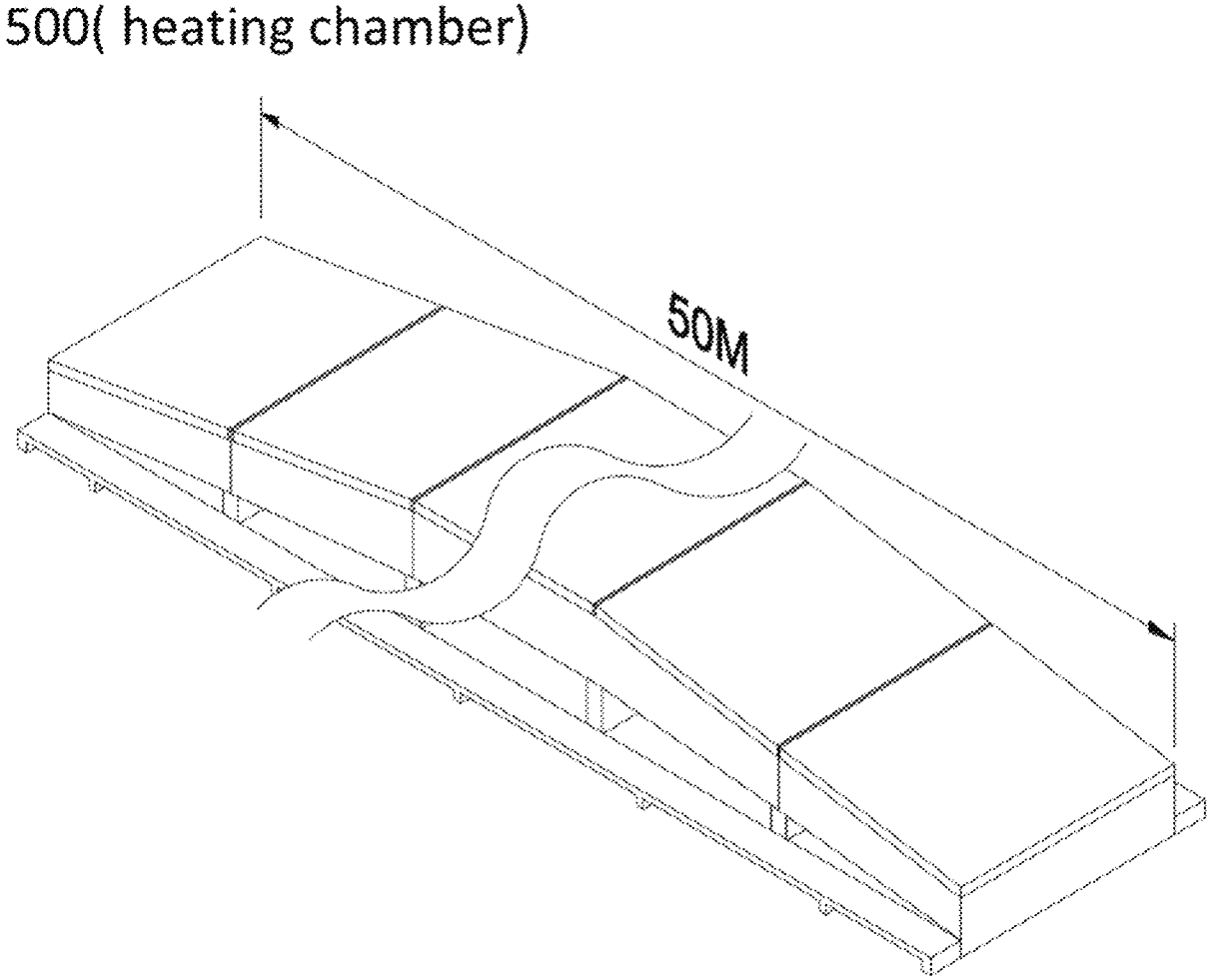
FIG. 9 is an enlarge view illustrating a heating chamber for performing a drying process in the apparatus for manufacturing the printing sheet for digital printing according to the present invention.
Figure 10:
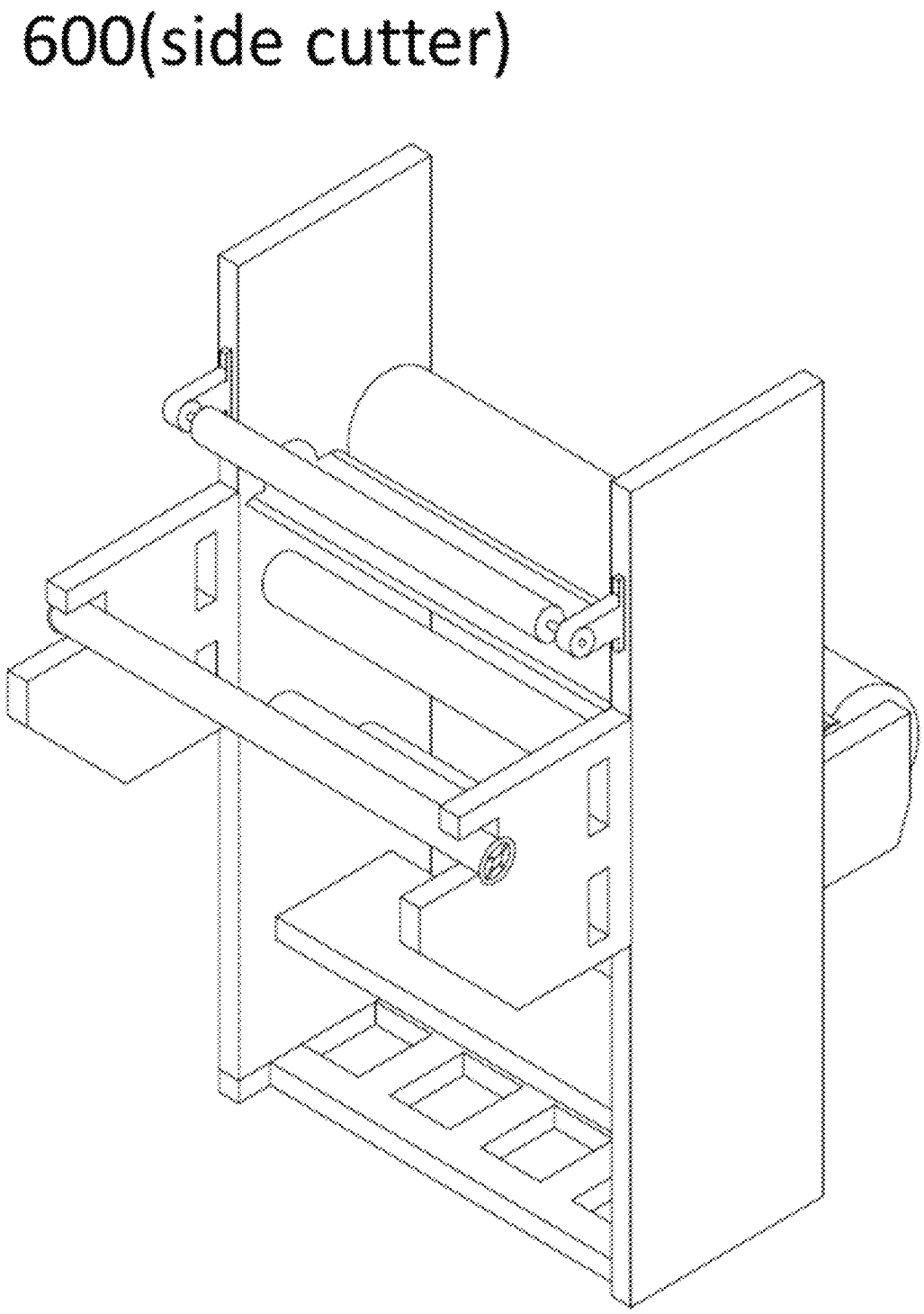
FIG. 10 is a view illustrating a side cutter for performing the side cutting process in the apparatus for manufacturing the printing sheet for digital printing according to the present invention.
Figure 11:
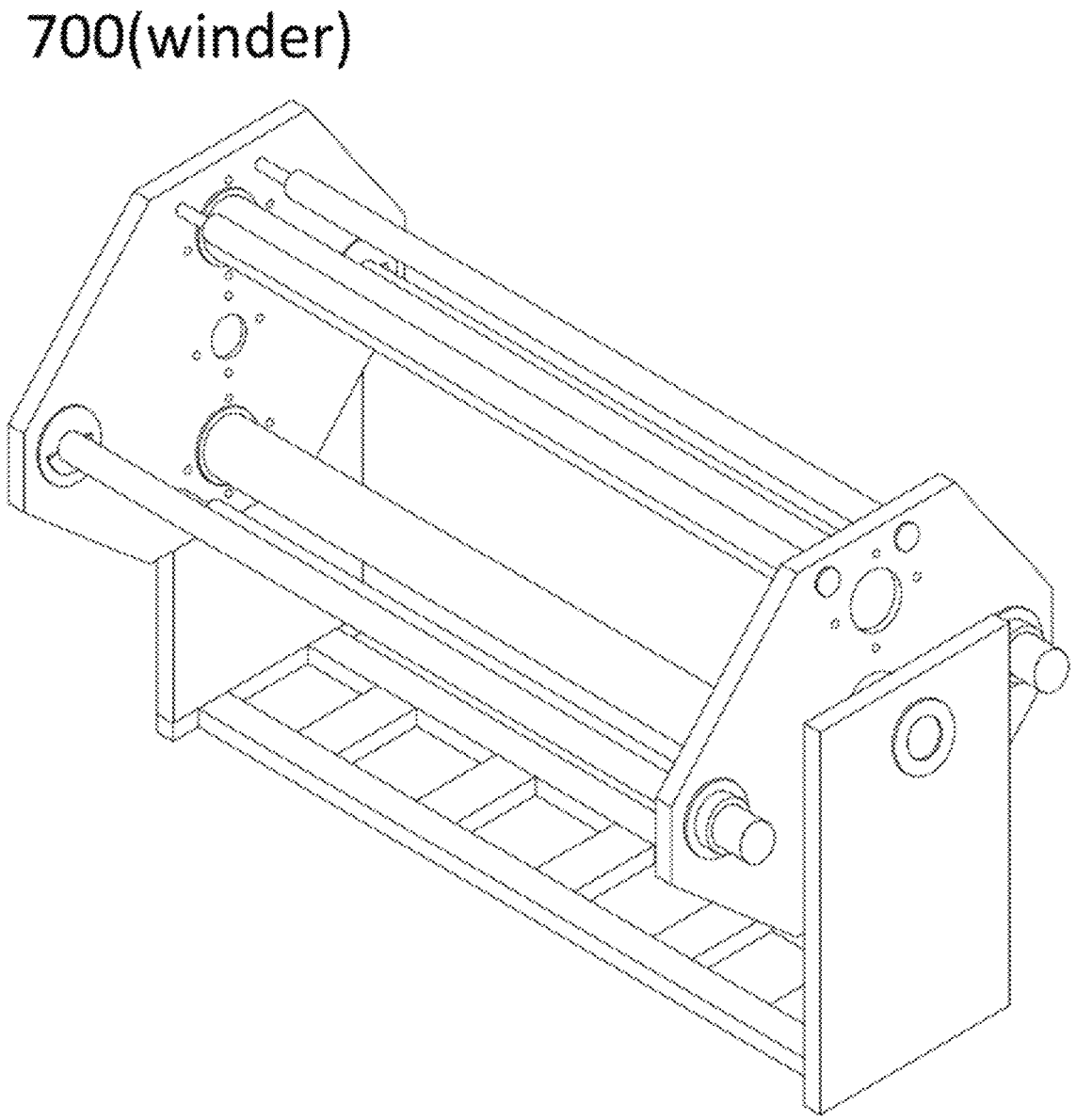
FIG. 11 is a view illustrating a winder for performing the winding process in the apparatus for manufacturing the printing sheet for digital printing according to the present invention.

Since the present invention discloses only embodiments for structural or functional description, the scope of the present invention should not be construed as being limited by the embodiments described in the specification. That is, since the embodiments can have various modifications and forms, it should be understood that the scope of the present invention includes equivalents capable of realizing the technical idea.

Since elements having the same function in all the drawings below use the same reference numerals, redundant descriptions are omitted. Terms to be described later are defined in consideration of functions in the present invention, which conforms to the technical spirit of the present invention.

Here, the meaning of the terms described in the present invention should be understood as follows.

Terms used in the description (e.g., a first, a second, etc.) are merely used to distinguish equal or similar items in an ordinal manner. For example, without departing from the scope of the present invention, a first element could be termed a second element, and similarly has a second element could be termed a first element.

When it is described that an element is "coupled to", "engaged with", or "connected to" another element, it should be understood that the element may be directly coupled or connected to the other element but still another element may be "coupled to", "engaged with", or "connected to" the other element between them. In addition, when the word 'directly' is referred, it means that no intervening constituent element is present. Also, other expressions describing the relationship between elements, such as "between" and "directly between" or "adjacent to" and "directly adjacent to" should be interpreted similarly.

The terms of a singular form may include plural forms unless referred to the contrary. The meaning of "include," "comprise," "including," or "comprising," specifies a property, a region, a fixed number, a step, a process, an element and/or a component but does not exclude other properties, regions, fixed numbers, steps, processes, elements and/or components.

In the description of the elements of the present invention, the terms 'first', 'second', 'A', 'B', '(a)', and '(b)' may be used. However, since the terms are used only to distinguish an element from another, the essence, sequence, and order of the elements are not limited by them. That is, respective steps may occur in the same order as specified, may be performed substantially simultaneously, or may be performed in the reverse order.

If not defined otherwise, all of the terms used (including technical or scientific terms) are equivalent to the counterparts as understood generally by one in the skilled in the art. Usual terms as defined in the dictionary are to be interpreted correspondingly to the context of the related technology rather than ideally or excessively formally unless the present invention clearly defines the same.

Moreover, detailed descriptions related to well-known functions or configurations will be ruled out in order not to unnecessarily obscure subject matters of the present invention.

Hereinafter, a method for manufacturing a printing sheet for digital printing using screen yarns woven with polyester monofilaments according to the present invention and a printing sheet for digital printing according to the same will be described in detail.

The present invention relates to a method for manufacturing a printing sheet for digital printing using screen yarns woven with polyester monofilaments by a coating processing and a post-processing such as a compression process and a drying process and a printing sheet for digital printing manufactured by the same.

A manufacturing apparatus 100 for forming a printing sheet for digital printing using screen yarns woven with polyester monofilaments includes: a first comma coating machine 200 and a second comma coating machine 300 for knife coating processes; a transfer device 400 for transferring a screen yarn fabric; a heating chamber 500 for drying a screen yarn that has undergone primary and secondary knife coating processes by hot air; a side cutter 600 for cutting both side gripping surfaces of the screen yarn that has undergone the secondary knife coating process and is heated by hot air while passing through the heating chamber 500; and a winder 700 for winding the screen yarn that has undergone the secondary knife coating process and having a predetermined width by cutting the both side gripping surfaces. In addition, a blower (fan) (not shown) is further included to perform a secondary drying process by performing a thermal curing process on the screen yarn that have undergone the winding process at room temperature of 40° C. to produce a printing sheet for digital printing using screen yarn woven with polyester monofilaments.

The first comma coating machine 200 that performs the primary knife coating process includes: a first coating roll 210 rotating to transfer the screen yarn fabric; a coating solution tank (no reference numeral) storing a coating solution that is a milky white viscous liquid of a PVA resin component for impregnating and coating the screen yarn fabric transferred along the first coating roll 210; a first comma knife 220 for knife-cutting to perform surface treatment (or surface leveling) while constantly cutting a primarily coated surface of the screen yarn; and a first vertical compression roller 230 for compressing the screen yarn that is knife-cut by the first comma knife 220 to complete the surface treatment (surface leveling) to a constant thickness.

Also, the second comma coating machine 300 that performs the secondary knife coating process includes: a second coating roll 310, a coating solution tank (no reference numeral), a second comma knife 320, and a second vertical compression roller 330, which is the same structure as the first comma coating machine 200, to perform the secondary knife coating process.

According to the present invention, the screen yarn woven with polyester monofilaments are woven by using 50 wt % or more of warp and/or weft yarns of polyester monofilaments suitable for high-precision printing.

According to the present invention, the polyester monofilament that is a core-sheath type composite fiber in which both a core component and a sheath component are polyethylene terephthalate (PET) is a core-sheath composite polyester monofilament in which the core component and the sheath component are PET, and the sheath component has an intrinsic viscosity (IV) less by at least 0.2 than that of the core component.

The polyester monofilament has a fineness of 3 to 8 dtex, a strength of 7.5 cN/dtex or more, a toughness (strength× elongation 0.5) of 29 or more, a yarn length fineness variation of 1.5% or less. In the polyester monofilament, a diameter portion having a thickness of +20% or more of an average fiber diameter of a cross-section of the monofilament is 1/100,000 m or less, the PET of the core component contains less than 0.5 wt % of titanium oxide, and the PET of the sheath component contains 0.3 wt % or more and 0.5 wt % or less of titanium oxide.

Hereinafter, the polyester monofilament will be described in more detail.

The polyester monofilament is a core-sheath type composite fiber in which both the core component and the sheath component are PET and the sheath component has an intrinsic viscosity (IV) less by at least 0.2 than that of the core component.

That is, since a degree of molecular orientation of a surface layer of the polyester monofilament is lowered when the intrinsic viscosity (IV) of the sheath component is less by at least 0.2 than that of the core component or when the intrinsic viscosity (IV) of the sheath component is equal to or greater than that of the core component, fluffy or sticky scum is not generated due to abrasion with a body wing during weaving.

The intrinsic viscosity (IV) of PET of the core component is 0.8 or more, and in terms of fluidity of the molten polymer in melt spinning, the intrinsic viscosity (IV) of the core component is preferably 1.4 or less, more preferably 1.3 or less.

Also, although the intrinsic viscosity (IV) of PET of the sheath component needs to be less by at least 0.2 than that of PET of the core component PET, in terms of stable metering in the melt extruder or spinneret, the intrinsic viscosity (IV) of PET of the sheath component is preferably equal to or greater than 0.4.

The polyester monofilament has a fineness of 3 to 8 dtex. That is, an upper limit of the fineness for weaving high mesh screen yarn of 400 meshes or more or 450 meshes or more suitable for precision printing is 8 dtex or less, preferably 6.5 dtex or less, and a lower limit of the fineness is 3 dtex or more, preferably 4 dtex or more for weaving property, especially sufficient weft yarn feeding.

The polyester monofilament has a strength of 7.5 cN/dtex. Preferably, the polyester monofilament has a strength of 8.0 cN/dtex or more, and more preferably, 8.5 cN/dtex or more.

Inorganic particle additives represented by titanium oxide added to the polyester fiber is preferably less than 0.5 wt %.

That is, in the polyester monofilament, the PET of the core component contains less than 0.5 wt % of titanium oxide, and the PET of the sheath component is mainly responsible for abrasion resistance, the inorganic particle additives represented by titanium oxide is preferably contained 0.1 to 0.5 wt %.

The PET of one of the core component and sheath component of the polyester monofilament may contain a copolymerization component.

For example, the copolymerization component contains: an acid component including a bifunctional aromatic carboxylic acid of one of isophthalic acid, phthalic acid, dibromoterephthalic acid, naphthalene dicarboxylic acid, diphenylxyentanecarboxylic acid, and oxyethoxybenzoic acid and a bifunctional aliphatic carboxylic acid of one of sebacic acid, adipic acid, and oxalic acid, and cyclohexane dicarboxylic acid; and a glycol component including polyoxyalkylene glycol of one of propanediol, butanediol, neopentyl glycol, bisphenol A, polyethylene glycol, or polyoxyalkylene glycol.

Also, as additives to the PET of one of the core and sheath components of the polyester monofilament, antioxidants, antistatic agents, plasticizers, ultraviolet absorbers, and colorants may be added.

An area ratio of the sheath and the core in a cross-section of a fiber of the polyester monofilament is preferably 40/60 to 5/95.

That is, since the core component of the polyester monofilament is responsible for strength and the sheath component is responsible for wear resistance, all of the core component and the sheath component are not damaged within the above-described range. More preferably, the area ratio of the sheath and the core is 30/70 to 10/90.

The toughness of the polyester monofilament needs to maintain at 29 or more, preferably 31 or more, and more preferably 32 or more.

The elongation of the polyester monofilament according to the present invention needs to satisfy a strength of 7.5 cN/dtex or more and toughness of 29 or more. However, when the elongation is 11% or more, the yarn may have stable weaving property, especially stable tension when the weft is inserted and thus have a reduce risk of breakage.

A yarn length fineness variation of the polyester monofilament according to the present invention is preferably 1.5% or less, more preferably 1.0% or less, and more preferably 0.7% or less. This is to uniformize a printing quality or an individual strength and elongation of the mesh when precision printing is performed with a high mesh screen yarn of 400 meshes or more.

Thus, according to the present invention, the polyester monofilament exhibiting characteristics of the above-described high quality screen yarn may be woven as the screen yarn suitable for high-precision printing by using polyester monofilament for at least 50 wt % of the warp and/or weft yarns in a method of mechanically maintaining or feeding the weft yarn using a Sulzer loom or a Rapier loom.

FIG. 1 is a flowchart representing a method for manufacturing a printing sheet for digital printing using screen yarns woven with polyester monofilaments according to the present invention.

As illustrated, according to the method for manufacturing a printing sheet for digital printing using screen yarns woven with polyester monofilaments, a printing sheet for digital printing may be manufactured by a process flowchart as stated below.

The method for manufacturing a printing sheet for digital printing using screen yarns woven with polyester monofilaments according to the present invention forms a printing sheet for digital printing by performing primary and secondary knife coating processes on a prepared screen yarn fabric and then performing a drying process, a cutting process of cutting side gripping surfaces into various widths, and a winding process of winding the yarn fabric into various lengths.

Hereinafter, the method for manufacturing a printing sheet for digital printing will be described in more detail.

1. Fabric Preparation Process S100;

Firstly, a fabric preparation process S100 prepares a screen yarn fabric woven with polyester monofilaments as described above.

The screen yarn is woven appropriately for high-precision printing by using the polyester monofilaments for at least 50 wt % of warp and/or weft yarns in a method of mechanically maintaining or feeding the weft yarn.

2. First Knife Coating Process S200;

A first knife coating process S200 includes: pushing the prepared screen yarn fabric upward along a rotating first coating roll 210 and impregnating and coating the screen yarn fabric with a coating solution, which is a milky white viscous liquid filled in a coating solution tank (no reference numeral) as a primary coating solution; performing surface treatment uniformly on the coated screen yarn by a first comma knife 220; and performing a compression process on the screen yarn fabric to have a constant thickness by a first vertical compression roller 230, so as to knife-coat the screen yarn woven with polyester monofilament by a first comma coating machine 200.

That is, the first knife coating process according to the present invention is performed by the first comma coating machine 200 in such a manner that the screen yarn fabric is impregnated while passing the coating solution tank (no reference numeral) in which the coating solution is stored along the first coating roll 210, and the coated screen yarn is continuously supplied and transferred to the first comma knife 220 supported by the first coating roll 210. An amount of the coating solution applied on the screen yarn fabric is controlled by a gap between the first coating roll 210 disposed at a lower side and the first comma knife 220 disposed at an upper side. A thickness of the coating solution is determined by a gap between the first comma knife 220 and the screen yarn fabric and a feeding speed of the screen yarn fabric to be coated. A coating thickness (wet) is 10 μm or more, and a viscosity is 700±100 CPS.

That is, the first knife coating according to the present invention is a coating method of performing a surface treatment while cutting a surface of the coated screen yarn by the first comma knife 220 within the gap between the first comma knife 220 and the screen yarn fabric coated with the coating solution.

The coating solution according to the present invention, which is a milky white viscous liquid of a PVA resin component, has a solid content of 20.0±1.0%, a viscosity of 700±100 CPS, an excellent coating property and color development, and excellent stringiness, is applicable to various substrates, and allows an ink to be dried when printing. The coating solution consists of 5 to 15% of isopropyl alcohol, 10 to 20% of ethylene-vinylacetate-vinyl alcohol, 5 to 15% of silica, 45 to 60% of water, 2 to 10% of polyvinyl alcohol polymers.

The first knife coating process S200 is classified in detail as stated below.

[Second-1 process] (First coating process) S210; Performed is a first coating process S210 of impregnating the screen yarn fabric while passing through the coating solution tank (no reference numeral) along the first coating roll 210 rotating to transfer the screen yarn fabric prepared in the process S100 and coating the screen yarn with the coating solution that is a milky white viscous liquid of a PVA resin component.

[Second-2 process] (First knife cutting process) S220; Performed is a first knife cutting process S220 of performing surface treatment while cutting a surface of the screen yarn, which is coated by the first comma knife 220, to uniformly perform the surface treatment on the surface of the screen yarn that is primarily coated in the process S210.

[Second-3 process] (First compression process) S230; Performed is a first compression process S230 of compressing the primarily knife-coated screen yarn with a constant thickness while the screen yarn that has undergone the surface treatment constantly by the first knife cutting process S220 passes the first vertical compression roller 230.

3. Second Knife Coating Process S300;

According to the present invention, a second knife coating process S300 is performed to secure an excellent coating property without fluidity of the screen yarn that has undergone the first knife coating process S200.

That is, the second knife coating process S300 is performed on the primarily knife-coated screen yarn that has undergone the first knife coating process S200 by a second comma coating machine 300 as same as the first knife coating process.

That is, the second knife coating process S300 is completed in such a manner that the knife-coated screen yarn that has undergone the first knife coating process S200 is pushed upward along a second coating roll 310 of the second comma coating machine 300 and impregnated and coated with a coating solution that is a milky white viscous liquid of a PVA resin component filled in a coating solution tank (no reference numeral) as a second coating solution, a surface of the screen yarn coated by a second comma knife 320 of the second comma coating machine 300 is uniformly surface-treated, and the screen yarn is compressed to have a constant thickness through a compression process by a second vertical compression roller 330 of the second comma coating machine 300.

The second knife coating process S300 is classified in detail as stated below as same as the first knife coating process S200.

[Third-1 process] (Second coating process) S310; A second coating process S310 of impregnating the screen yarn fabric while passing through the coating solution tank (no reference numeral) along the second coating roll 310 of the second comma coating machine 300 rotating to transfer the screen yarn fabric that has undergone the first knife coating process in the process S200 and secondarily coating the screen yarn with the coating solution that is the milky white viscous liquid of the PVA resin component is performed to secure an excellent coating property without fluidity of the screen yarn.

[Third-2 process] (Second knife cutting process) S320; Performed is a second knife cutting process S320 of performing surface treatment while cutting a surface of the screen yarn, which is secondarily coated by the second comma knife 320, to uniformly perform the surface treatment on the surface of the screen yarn that is secondarily coated in the process S310.

[Third-3 process] (Second compression process) S330; Performed is a second compression process S330 of compressing the secondarily knife-coated screen yarn with a constant thickness while the screen yarn that has undergone the surface treatment constantly by the second knife cutting process S320 passes the second vertical compression roller 330.

4. Transfer Process S400;

A transfer process S400 of transferring the screen yarn that has undergone the first and second knife coating processes of the processes S200 to S300 to a heating chamber 500 is performed by a transfer device 400 in order to dry the screen yarn.

5. First Drying Process S500;

A first drying process S500 is performed by hot air through the heating chamber 500 having a temperature of 180° C. to 220° C. to dry the screen yarn that has undergone the first and second knife coating processes of the processes S200 to S300.

6. Side Cutting Process S600;

A cutting process S600 of cutting both side gripping surfaces of the secondarily knife-coated screen yarn that is thermally dried while passing the heating chamber 500 in the process S500 by a side cutter 600 into various widths (1270 mm to 1320 mm).

7. Winding Process S700;

The winding process S700 of winding the secondarily knife-coated screen yarn having a predetermined width by side-cutting both left and right gripping surfaces in the process S600 into various lengths by using a winder 700 is performed.

The screen yarn may be wound into various sizes such as 1270 mm×30 m, 1270 mm×50 m, 1270 mm×100 m, 1270 mm×150 m, 1320 mm×30 m, 1320 mm×50 m, 1320 mm×100 m, 1320 mm×150 m regardless of sizes depending on the purpose of use to realize a large-sized printing.

8. Second Drying Process S800;

A second drying process S800 of performing a thermal curing process on the screen yarn that has undergone the winding process S700 at a room temperature of 40° C. by a blower (fan) (not shown) is performed to form a printing sheet for digital printing.

Thus, the printing sheet for digital printing manufactured by the method for manufacturing the printing sheet for digital printing using the screen yarn woven with the polyester monofilament according to the present invention is combined with various technologies such as oil (solvent) printing, PVC cal printing, water-based printing, UV printing, latex printing, and fluorescent printing to realize excellent printing output in comparison with a conventional woven fabric and is excellent in terms of durability, heat resistance, and weatherability. Also, the printing sheet does not cause scratches or damages on a printed surface even without using a release coating film, is suitable for a printing material in terms of paper texture and shading, and is useful for inventory and inventory risk management because the printing sheet has superior competitiveness and a multiple printing capability in comparison with conventional technologies.

Also, the printing sheet for digital printing manufactured by the method for manufacturing the printing sheet for digital printing using the screen yarn woven with the polyester monofilament according to the present invention is advantageous in terms of improved process rate and productivity through a punching process immediately after printing, a reduced delivery delay time, and a reasonable price. In addition, the printing sheet may: realize a natural state such as scenery thereon through sewing after printing; perform sales and advertisements such as large concert halls, department stores, and large discount marts because the printing sheet may realize a large-sized printed material regardless of sizes; and be displayed for a long period of time due to excellent durability and weatherability in comparison with a banner.

Also, the printing sheet for digital printing manufactured by the method for manufacturing the printing sheet for digital printing using the screen yarn woven with the polyester monofilament according to the present invention may be recycled from various environmental factors that may occur during disposal after displaying a printed material based on an eco-friendly coating agent and water-based composition and secure excellent printability without being affected by humidity and temperature based on excellent weatherability.

The method for manufacturing the printing sheet for digital printing using the screen yarn woven with the polyester monofilament and the printing sheet for digital printing manufactured by the same according to the present invention are combined with various technologies such as oil (solvent) printing, PVC cal printing, water-based printing, UV printing, latex printing, and fluorescent printing to realize excellent printing output in comparison with a conventional woven fabric and are excellent in terms of durability, heat resistance, and weatherability.

The method for manufacturing the printing sheet for digital printing using the screen yarn woven with the polyester monofilament and the printing sheet for digital printing manufactured by the same according to the present invention do not cause scratches or damages on a printed surface even without using a release coating film, are suitable for a printing material in terms of paper texture and shading, are useful for inventory and inventory risk management because the printing sheet has superior competitiveness and the multiple printing capability in comparison with conventional technologies.

The method for manufacturing the printing sheet for digital printing using the screen yarn woven with the polyester monofilament and the printing sheet for digital printing manufactured by the same according to the present invention are advantageous in terms of the improved process rate and productivity through a punching process immediately after printing, the reduced delivery delay time, and the reasonable price.

The method for manufacturing the printing sheet for digital printing using the screen yarn woven with the polyester monofilament and the printing sheet for digital printing manufactured by the same according to the present invention may: realize a natural state such as scenery thereon through sewing after printing; perform sales and advertisements such as large concert halls, department stores, and large discount marts because the printing sheet may realize a large-sized printed material regardless of sizes; and be displayed for a long period of time due to excellent durability and weatherability in comparison with a banner.

The method for manufacturing the printing sheet for digital printing using the screen yarn woven with the polyester monofilament and the printing sheet for digital printing manufactured by the same according to the present invention may be recycled from various environmental factors that occur during disposal after displaying a printed material based on an eco-friendly coating agent and water-based composition and secure excellent printability without being affected by humidity and temperature based on excellent weatherability.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

The invention claimed is:

1. A method for manufacturing a printing sheet for digital printing by using a screen yarn woven with a polyester monofilament, the method comprising:

a process of preparing a screen yarn fabric woven for printing by using the polyester monofilament for at least 50 wt % of warp and/or weft yarns in a method of mechanically maintaining or feeding the weft yarn;

a first knife coating process of performing surface treatment while cutting a surface of the screen yarn fabric woven with polyester monofilaments by a first comma coating machine in a gap between a first comma knife of the first comma coating machine and the screen yarn fabric coated with a coating solution;

a second knife coating process of knife-coating the screen yarn, which is knife-coated in the first knife coating process by the first comma coating machine, by a second comma coating machine as same as the first knife coating process to secure a coating property without liquidity;

a transfer process of transferring the screen yarn that has undergone the first and second knife coating processes to a heating chamber by a transfer device in order to dry the screen yarn;

a first drying process of thermally drying the screen yarn that has undergone the first and second knife coating processes through the heating chamber having a temperature of 180° C. to 220° C.;

a side cutting process of cutting both side gripping surfaces of the knife-coated screen yarn that is thermally dried while passing the heating chamber in the first drying process by a side cutter to side-cut both side surfaces into various widths of a constant size; and a winding process of forming the knife-coated screen yarn that has a predetermined width by side-cutting the both side gripping surfaces in the side cutting process into various sizes by using a winder.

2. The method of claim 1, further comprising a second drying process of performing a thermal curing process on the screen yarn that has undergone the winding process at a room temperature of 40° C. by a blower.

3. The method of claim 1, wherein the coating solution, which is a PVA resin component, has a solid content of 20.0±1.0% and a viscosity of 700±100 CPS.

4. The method of claim 1, wherein the coating solution consists of 5 to 15% of isopropyl alcohol, 10 to 20% of ethylene-vinylacetate-vinyl alcohol trimer, 5 to 15% of silica, 45 to 60% of water, and 2 to 10% of polyvinyl alcohol polymers.

5. The method of claim 1, wherein the first knife coating process comprises:

pushing the prepared screen yarn fabric upward along a rotating first coating roll of the first comma coating machine and impregnating and coating the screen yarn fabric with the coating solution, which is filled in a coating solution tank;

performing surface treatment uniformly on the coated screen yarn by the first comma knife of the first comma coating machine; and performing a compression process on the screen yarn fabric to have a predetermined thickness by a first vertical compression roller of the first comma coating machine, so as to knife-coat the screen yarn woven with polyester monofilament by the first comma coating machine.

6. The method of claim 1, wherein the first knife coating process comprises:

a first coating process of impregnating the screen yarn fabric prepared in the process of preparing the screen yarn fabric while passing through a coating solution tank along a first coating roll of the first comma coating machine rotating to transfer the screen yarn fabric and coating the screen yarn with the coating solution that is a PVA resin component;

a first knife cutting process of performing surface treatment while cutting a surface of the screen yarn, which is coated by the first comma knife of the first comma coating machine, to uniformly perform the surface treatment on the surface of the screen yarn that is coated in the first coating process; and a first compression process of compressing the knife-coated screen yarn with a predetermined thickness while the screen yarn that has undergone the surface treatment constantly by the first knife cutting process passes a first vertical compression roller of the first comma coating machine.

7. The method of claim 1, wherein the second knife coating process comprises:

pushing the knife-coated screen yarn that has undergone the first knife coating process upward along a rotating second coating roll of the second comma coating machine and impregnating and coating the screen yarn with the coating solution that is a PVA resin component filled in a coating solution tank as a second coating solution;

performing surface treatment uniformly on a surface of the screen yarn coated by a second comma knife of the second comma coating machine; and knife-coating the screen yarn to have a predetermined thickness through a compression process by a second vertical compression roller of the second comma coating machine.

8. The method of claim 1, wherein the second knife coating process comprises:

a second coating process of impregnating the screen yarn while passing through a coating solution tank along a second coating roll of the second comma coating machine rotating to transfer the screen yarn that has undergone the first knife coating process and coating the screen yarn with the coating solution that is a PVA resin component;

a second knife cutting process of performing surface treatment while cutting a surface of the screen yarn, which is coated by a second comma knife of the second comma coating machine, to uniformly perform the surface treatment on the surface of the screen yarn that has undergone the second coating process; and a second compression process of compressing the knife-coated screen yarn with a predetermined thickness while the screen yarn that has undergone the surface treatment constantly by the second knife cutting process passes a second vertical compression roller to secure stability of the screen yarn fabric.

9. The method of claim 1, wherein the polyester monofilament is a core-sheath type composite polyester monofilament in which both a core component and a sheath component are polyethylene terephthalate, and the sheath component has an intrinsic viscosity less by at least 0.2 than that of the core component.

10. The method of claim 9, wherein PET of one of the core component and sheath component of the polyester monofilament contains a copolymerization component, and an additive including monofilament, antioxidants, antistatic agents, plasticizers, ultraviolet absorbers, and colorants is added to the PET of one of the core and sheath components of the polyester monofilament.

11. The method of claim 10, wherein the copolymerization component comprises:

an acid component comprising a bifunctional aromatic carboxylic acid of one of isophthalic acid, phthalic acid, dibromoterephthalic acid, naphthalene dicarboxylic acid, diphenylxyentanecarboxylic acid, or oxyethoxybenzoic acid and a bifunctional aliphatic carboxylic acid of one of sebacic acid, adipic acid, oxalic acid, or cyclohexane dicarboxylic acid; and a glycol component comprising polyoxyalkylene glycol of one of propanediol, butanediol, neopentyl glycol, bisphenol A, polyethylene glycol, or polyoxyalkylene glycol.

* * * * *